US008864180B2

(12) United States Patent
Harman et al.

(10) Patent No.: US 8,864,180 B2
(45) Date of Patent: Oct. 21, 2014

(54) ARTICULATED GUTTER DOWNSPOUT FITTING

(71) Applicants: Jon P. Harman, Louisville, CO (US); Eric J. Harman, Boulder, CO (US)

(72) Inventors: Jon P. Harman, Louisville, CO (US); Eric J. Harman, Boulder, CO (US)

( * ) Notice: Subject to any disclaimer, the term of this patent is extended or adjusted under 35 U.S.C. 154(b) by 0 days.

(21) Appl. No.: 13/662,912

(22) Filed: Oct. 29, 2012

(65) Prior Publication Data

US 2014/0117661 A1 May 1, 2014

(51) Int. Cl.
*F16L 27/04* (2006.01)

(52) U.S. Cl.
USPC ..... 285/261; 285/146.1; 52/16

(58) Field of Classification Search
USPC ..... 285/184, 146.1, 146.2, 146.3, 261; 137/615; 138/118, 109; 52/16
See application file for complete search history.

(56) References Cited

U.S. PATENT DOCUMENTS

| | | | | | |
|---|---|---|---|---|---|
| 444,099 | A * | 1/1891 | Humphreys | 285/261 |
| 1,041,515 | A * | 10/1912 | Rourke | 285/261 |
| 1,772,547 | A * | 8/1930 | Keese et al. | 285/146.1 |
| 1,868,696 | A * | 7/1932 | Crary | 285/261 |
| 2,556,659 | A * | 6/1951 | Patterson | 285/261 |
| 3,076,669 | A | 2/1963 | Schlein | |
| 3,861,419 | A | 1/1975 | Johnson | |
| 4,946,202 | A * | 8/1990 | Perricone | 285/184 |
| 5,358,006 | A | 10/1994 | Sweers | |
| 5,375,891 | A * | 12/1994 | Sicotte et al. | 285/184 |
| 5,441,364 | A * | 8/1995 | Dressler | 52/16 |
| 5,511,829 | A * | 4/1996 | Sicotte et al. | 285/184 |
| 5,921,694 | A * | 7/1999 | Herbermann | 285/184 |
| 6,041,825 | A | 3/2000 | Smith et al. | |
| 6,220,636 | B1 * | 4/2001 | Veloskey et al. | 285/261 |
| 6,575,654 | B2 * | 6/2003 | Wentworth et al. | 285/146.1 |
| D671,624 | S * | 11/2012 | Harman et al. | D23/267 |
| D673,249 | S * | 12/2012 | Harman et al. | D23/267 |

* cited by examiner

*Primary Examiner* — David E Bochna
(74) *Attorney, Agent, or Firm* — Patent Law Offices of Rick Martin, P.C.

(57) ABSTRACT

Rain gutter downspouts are fitted with either a one ball or two ball and socket joint. The joint is rigid. It bends up to 30° for a one ball joint or 60° for a two ball joint. Non-sealing joints are used to draw air downstream with the water. Further debris and clog clearing is provided with a venturi effect coupled with an acceleration along the concave sides of the balls toward the center of the gutter downspout pipes. Rotation of the ball along with tilt give the installer flexibility in keeping the wide side of the downspout pipe flush with the house as well as allowing zig zag patterns to avoid windows.

20 Claims, 18 Drawing Sheets

ARTICULATED GUTTER DOWNSPOUT FITTING

CROSS REFERENCE PATENTS

This is a continuation in part of U.S. patent application Ser. No. 29/387,260 filed Mar. 10, 2011 and Ser. No. 29/387,258 filed Mar. 10, 2011.

FIELD OF INVENTION

The present invention relates to a ball and socket type joint connected to a rain gutter downspout to allow up to about a sixty degree joint angle.

BACKGROUND OF THE INVENTION

For many years, buildings have been equipped with gutters and downspouts for removing water from their roofs and away from their foundations. Typically, the gutters of a building are connected to a number of downspouts so that the force of gravity will cause the rainwater to travel down the incline, through the downspout and exit the opening of the downspout. The inclined gutters are designed so that water does not collect in any one place in the gutters. The downspouts are rigidly attached to nearby walls of the building to support the weight and fluid forces caused by the rainwater.

Several problems of known downspout systems are that the elbows between the gutter and the vertical downspout section have only one fixed angle, the angle cannot be adjusted, and they can only bend in one vertical plane. Additionally known elbows between the gutter and the vertical downspout cannot be rotated to redirect the attaching vertical downspout section in a direction to avoid a window or some other feature prohibiting downspout attachment to the building's wall. At the bottom of a downspout system a lower attaching elbow is used to direct the water away from the building. Because the lower attaching elbow only directs water a short distance away from the building piece of downspout extending on the ground away from the building can be connected to the elbow to exhaust the water further away from the building. However, adding another piece of downspout has several drawbacks. One drawback is that the downspout can only be extended in the same linear direction of the elbow of the downspout because the downspout material is not flexible or bendable. Another drawback is that for lawn care or other reasons and the extension of downspout material can be cumbersome to move. Also, the downspout material may be expensive in comparison to other materials.

No known attempts have been made to provide a downspout elbow between the attaching gutter and the vertical downspout section that has an adjustable angle, is 360 degrees rotatable, and is made of rigid material that is not susceptible to cracking. Attempts have been made in the art to provide a downspout extension at the bottom of the vertical downspout that directs water away from a building without simply adding another piece of downspout material. Some examples of these attempts are the bendable, "corrugated" plastic pipes and adapters that are connected to a downspout. Other examples are described in the patents to Sweers (U.S. Pat. No. 5,258,006), Schlein (U.S. Pat. No. 3,076,669), Johnson (U.S. Pat. No. 3,861,419), and Smith et al. (U.S. Pat. No. 6,041,825).

Bendable, corrugated, plastic pipe extensions and adapters, such as supplied by Advanced Drainage Systems, Inc. of Montezuma, Ga., are known in the prior art. The adapter is connected to the downspout and then the bendable, corrugated plastic pipe is connected to the adapter. Although these corrugated, plastic pipe downspout extensions direct water away from the foundation of a building, they suffer from several drawbacks. One drawback of these corrugated, plastic pipe downspout extensions is that although bendable, they will not hold their position. Thus elbows are required when the user needs a turn in the downspout extensions.

Sweers, U.S. Pat. No. 5,358,006, describes an adjustable extension assembly for a downspout that includes a fixed piece attachable to the lowermost end of a downspout, a rotatable collar attached to the fixed piece, and at least one extension pivotably attached to the rotatable collar. The directions and the assembly can be extended to different lengths. However, one of the drawbacks of Sweers is that the assembly can point only linearly and cannot bend around objects.

Schlein, U.S. Pat. No. 3,076,669, describes a plastic bellows elbow with spigot and socket ends. The device is configured for connecting an eaves trough to a downspout. The elbow comprises plastic having limited flexibility and a tendency to cold flow to a predetermined set under sustained pressure and having an elastic memory. The intermediate portion of the coupling is described as being provided with a "bellows formation" that provides a certain degree of flexibility, allowing it to be bent in any direction and expand and contract. However, the bellows in Schlein will not hold its position.

Johnson, U.S. Pat. No. 3,861,419, describes a hinged extension for downspouts. The hinge allows the downspout extension to be selectively disengaged from the downspout so that the extension can be pivoted to provide clearance for routine yard work. However, the hinged extension described by Johnson is not bendable or flexible and only points in the same direction as the downspout.

Another problem in the prior art is the need to direct the downspout from the gutter at a large angle without the use of a bellows formation. These bellows formations decompose and/or crack and they are unsightly hanging high up and visible on a house. See Schlein '669 at FIG. 7. These bellows formations cannot be rotated 90° to allow the downspout to mount with its longest edge against the house wherein some gutters extend beyond a corner and require this.

What is needed in the art is a rigid downspout joint that is short, esthetically pleasing, inexpensive, durable, 360° rotatable, and bendable up to about 60°. The present invention meets these requirements using a loose ball and socket construction.

The problems solved by the use of this gutter and downspout connection/coupling are the following:

The device allows for positioning of the rectangular downspout in either its long cross sectional dimension, or its short cross sectional dimension with respect to its attaching surface. (What we mean to say is that it can be rotated 90° out of plane.)

The device allows for adjustability of "out-of-plane" downspout attachment points, whereas existing fixed angle couplings/connectors do not. (The plane of the attaching wall may not be parallel with the downward plane of the downspout.)

The device allows for rotation with respect to a fixed gutter outlet point.

The downspout device is comprised of a 2-piece or 3-piece unit that does not need to be glued together from mismatched parts from a hardware store. For instance, to make a part that only allows rotation you would need to buy a length of pipe (sold in 10' lengths), two rectangular-to-round female fittings, PVC glue, and sealant to seal the lowest female fitting to the downspout.

The downspout device allows for "in-place adjustment" when installing downspouts. (It is not possible to make in-place adjustments with existing fittings as removal is required to glue the assembly for final placement).

The downspout device allows for variable angle adjustments that allow installers to get around obstructions.

The downspout device allows for non-conventional angles (typical conventional angles are 30 degrees, 45 degrees, and 60 degrees) which may be required during installation due to variable gutter overhang distances. The distance from the adjoining house wall to the gutter overhang can vary from house to house.

The downspout device allows for rotation and articulation. Conventional rectangular gutter outlet connections do not allow for rotation of attached conventional rectangular downspouts.

The downspout device gradually accelerates the fluid in the joint by a reducing area causing a venturi effect. From Bernoulli's principle, this creates a slightly more negative pressure which reduces the tendency of leaking at the joint. Conventional downspout fittings do not accelerate the fluid and are more likely to leak at their downspout attachment point.

The downspout device has a circular-arc radial contour in its inner cavity that causes the fluid to be redirected toward the center of the joint. This fluid-centering action of the downspout device reduces the tendency of leaking at the joint. Conventional downspout fittings do not redirect the fluid to the center of the fitting and are more likely to leak at their downspout attachment point.

The downspout device has a circular-arc radial contour in its inner cavity that causes the fluid to be redirected toward the center of the joint. This fluid-centering action of the downspout device redirects sediment and debris towards the center of the joint and reduces the tendency of the fitting to clog. The fluid-centering action forces sediment and debris to move into the faster moving fluid stream in the center of the fitting. Conventional downspout fittings do not redirect the fluid to the center of the fitting and are more likely to clog.

The downspout device is intentionally designed to be non-sealing and to have an air passageway near the reducing area section of the device which allows air to enter into the assembly as the fast moving fluid travels downward. This air passageway eliminates "vapor-lock" when transient slugs of fluid bridge across the entire cross-sectional area of the fitting at the narrowing cross-sections. Most conventional downspout fittings have a water-tight seal at their narrowest internal cross section and when transient slugs of water bridge across their narrowest internal cross section, transient "vapor-lock" can occur slowing down the flow of fluid through the fitting and the downspout. Other conventional downspout fittings may be of poor construction and may not seal tight at their downspout attachment point allowing air to enter. Air entering at this location is not at a narrowing cross-section and therefore does not reduce "vapor-lock" as effectively.

The downspout device is intentionally designed to be non-sealing and to have an air passageway near the reducing area section of the device which allows air to enter into the assembly as the fast moving fluid travels downward. Because this air passageway is located at the narrowing section, from Bernoulli's principle a more negative pressure will occur. This more negative pressure reduces the fluid's ability to travel upwards vertically along the air passage way. This produces an effective liquid-vapor seal and reduces the tendency to leak. Conventional downspout fittings do not have this feature and have a greater tendency to leak at their downspout attachment point.

The downspout device has slotted or depressed surface sections on the sphere (ball) section allowing for easier insertion of the sphere (socket) section. Conventional fluid handling ball and socket joints do not have this feature. (When the ball is inserted or pressed into the socket, the slots make it easier for the two mating pieces to slide passed each other during assembly).

The downspout device is non-pressure holding and is designed with the mating ball radius being smaller than the mating socket radius. The difference between the two radii allows for easier insertion of the ball part to the socket part without exceeding the material elastic limit of the two parts. Other conventional ball and socket fluid handling joints do not have his feature because they are designed to seal the fluid pressure.

The downspout device has multiple pivot points (foci) from which to pivot, which adds additional movability (increased angular articulation). Multiple pivot points can occur because the device is non-sealing. Conventional ball and socket fluid holding devices require the ball radius and the socket radius location to be coincident to each other for fluid sealing. This reduces potential angular articulation of conventional ball and socket fluid holding devices.

Additionally the downspout device ball and socket design does not need to have a water tight seal because of the downward and overlapping design.

The invention has the following advantages over the prior art:

1. It allows for rotation and variable angle articulation.
2. It can make changes in direction in a very short axial and lateral distance.
3. It has ample wall thickness to add to its durability and strength. In part because of the non-sealing nature of the design, the ball and socket mating parts can be thicker and still remain easy to assemble.
4. It is easy for the installer to manipulate, and install.
5. It is short in length in comparison to its cross section.
6. It can most likely be extrusion blow molded, which leads to lower costs of production.
7. It does not need to be flexible to produce its functions. This means it can be made from stronger and more durable material.
8. It has a smaller profile, which is more visually appealing.
9. It has a lower weight because of its smaller profile which reduces shipping costs.
10. It allows for sediment to be flushed through with each rain fall.
11. Its socket and ball design does not need to be a water tight connection, because of the downward and over lapping design.
12. The tendency of the separate parts to creep apart from one another is eliminated by not having a tight junction between the two mating parts. Fluid-tight ball and socket joints have an interference fit between the mating parts and the material creeps and relaxes over time causing cracking and failure.

SUMMARY OF THE INVENTION

The main aspect of the present invention is to provide a single or a double ball and socket rigid joint for a gutter downspout.

Another aspect of the present invention is to provide a loose fitting ball joint to reduce leakage by accelerating the downward water flow toward the center of the downspout using a combination of air entering the joint, a curvature of the socket and a narrowing of the cross sectional area of the channel.

Another aspect of the present invention is to provide an upper and a lower rectangle adapter portion on the joint for connecting downspout members thereto.

Another aspect of the present invention is to provide up to about a 60° angled joint using the dual ball and socket embodiment.

Other aspects of this invention will appear from the following description and appended claims, reference being made to the accompanying drawings forming a part of this specification wherein like reference characters designate corresponding parts in the several views.

Figure 1:
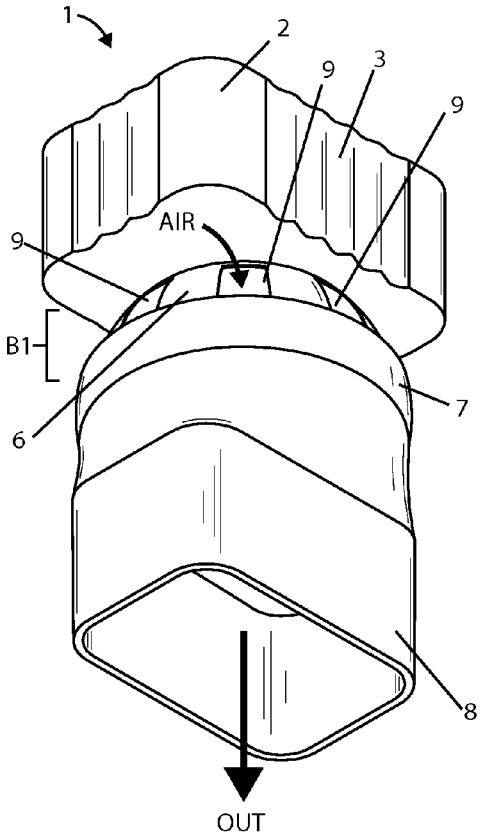
FIG. 1 is a bottom perspective view of our new design for a single ball downspout joint.
Figure 2:
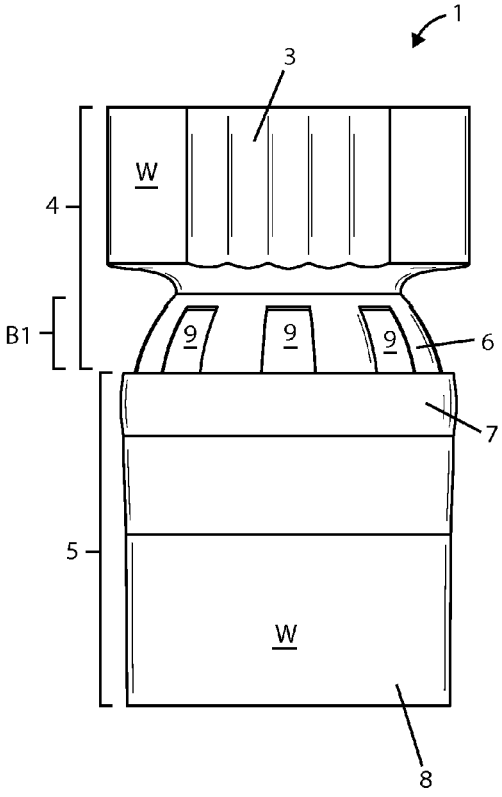
FIG. 2 is a front elevation view of our new design for a single ball downspout joint, wherein a rear elevation view is identical.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Referring first to FIGS. 1-5 a single ball joint 1 has an upper rectangular adaptor 2 with curved mating ridges 3 to readily accept prior art gutter downspouts. The upper body 4 has a ball 6 which fits into the socket 7 of the lower body 5. The lower body 5 has a lower rectangular adaptor 8 which is sized to fit inside traditional rain downspout tubing. The ball and socket joint is designated B1. This joint B1 socket joint is non-sealing so as to let air pass through recesses 9. Arrow AIR shows how ambient air rushes through the recesses 9 during water flow so as to combine with the water in a downward flow shown by arrow OUT. Nominal dimensions are d1=2.5 inches, and d2=3.7 inches.

Figure 3:
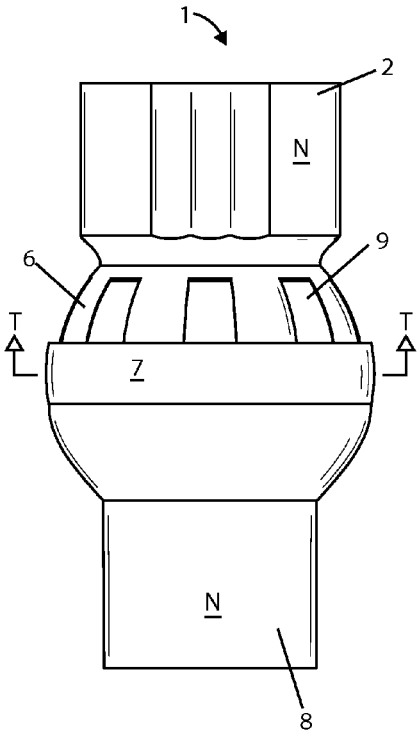
FIG. 3 is a left side elevation view of our new design for a single ball downspout joint, wherein a right side elevation view is identical.
Figure 4:
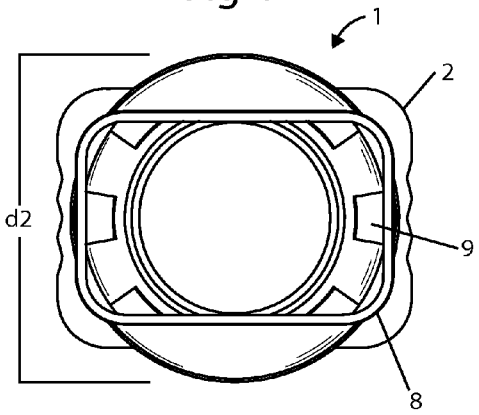
FIG. 4 is a bottom plan view of our new design for a single ball downspout joint.
Figure 5:
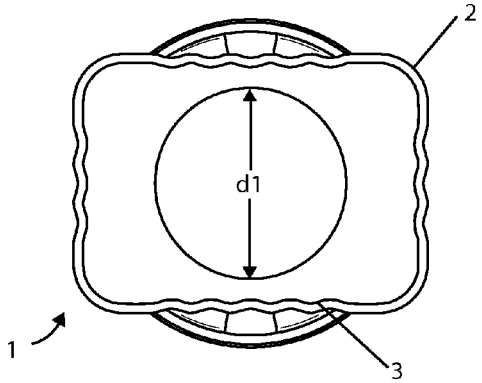
FIG. 5 is a top plan view of our new design for a single ball downspout joint.

FIG. 3 shows that socket 7 can be rotated around ball 6 shown by arrow T. The wide sides of the rectangular adapters 2, 8 are shown by W. The narrow sides are shown by N. Thus, socket 7 can be rotated to provide a wide side of the upper rectangular adapter 2 to align with the narrow side of the lower rectangular adapter 8. This feature allows installers to keep the wide side of the downspout tubes against the building wall regardless of the orientation of the downspout above.

Figure 6:
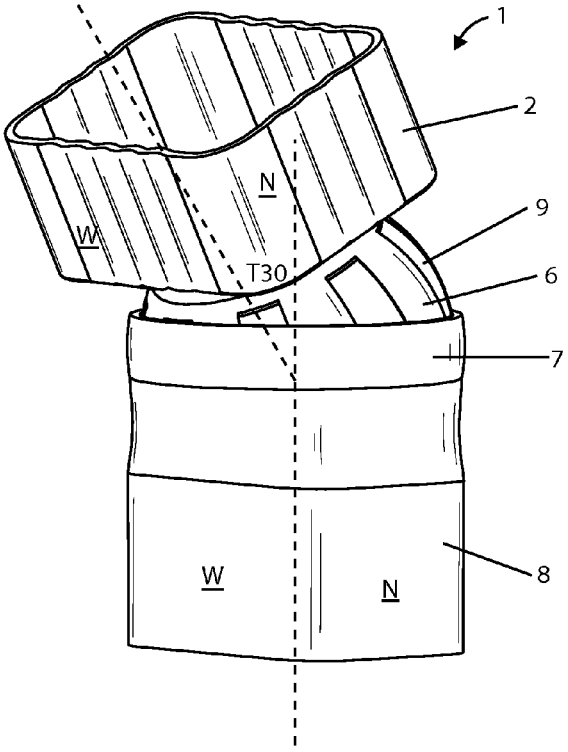
FIG. 6 is a front perspective view of our single ball downspout joint articulated toward the front of the joint.
Figure 7:
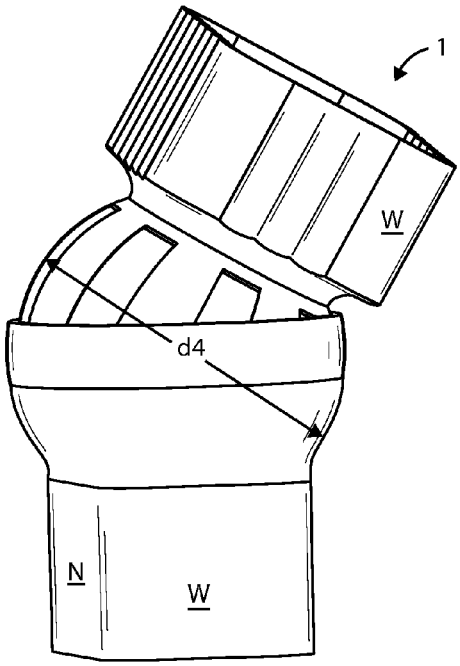
FIG. 7 is a front perspective view of our single ball downspout joint articulated toward the right side of the joint.
Figure 8:
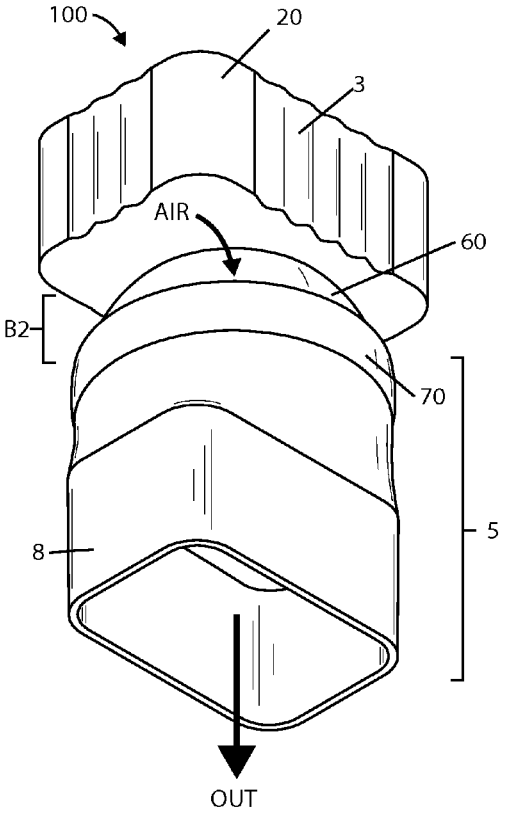
FIG. 8 is a bottom perspective view of our single oval embodiment new design for the single ball downspout joint.
Figure 9:
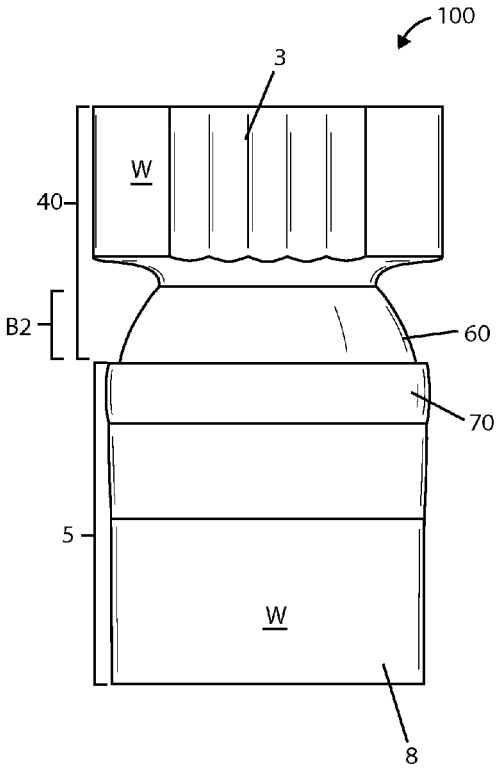
FIG. 9 is a front elevation view of our single oval embodiment for the single ball downspout joint, wherein a rear elevation view is identical.
Figure 10:
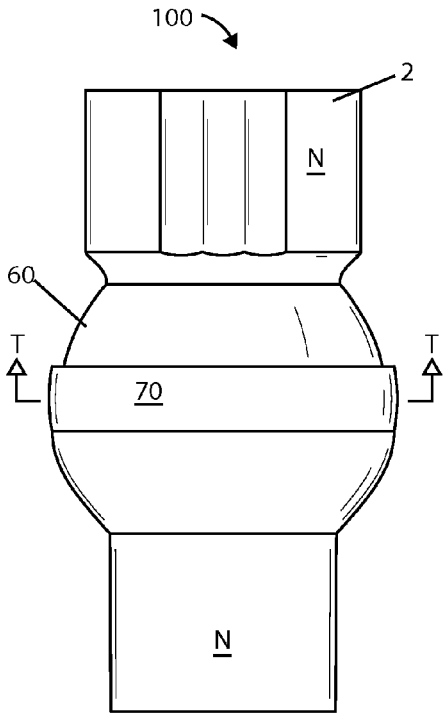
FIG. 10 is a left side elevation view of our single oval embodiment for the single ball downspout joint, wherein a right side elevation view is identical.
Figure 11:
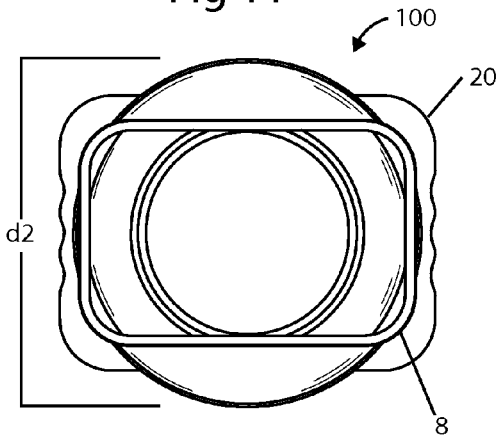
FIG. 11 is a bottom plan view of our single oval embodiment single ball downspout joint.
Figure 12:
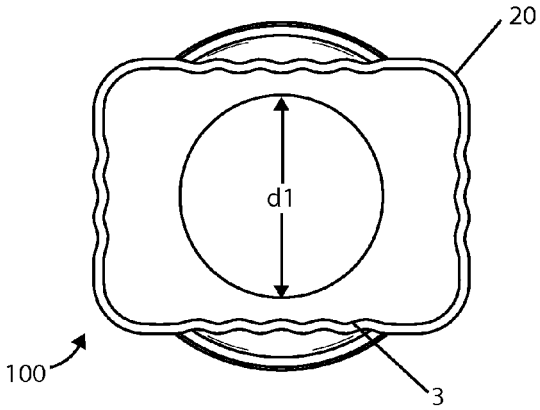
FIG. 12 is a top plan view of our single oval embodiment single ball downspout joint.
Figure 13:
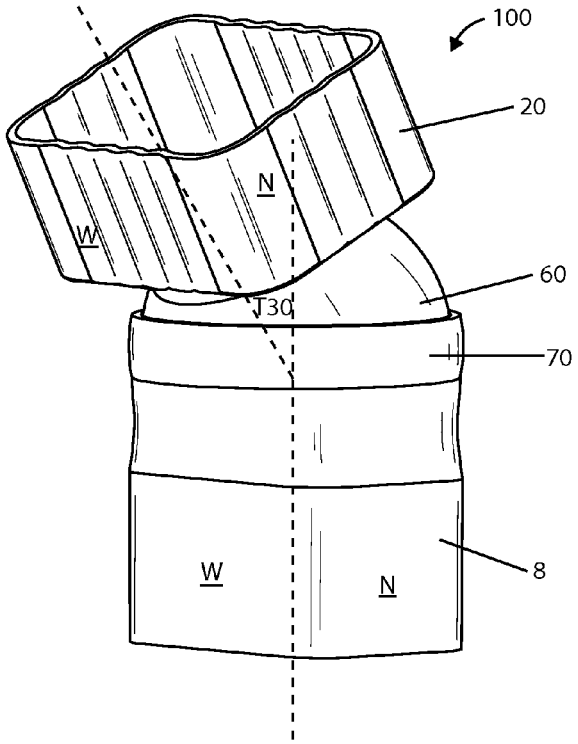
FIG. 13 is a front perspective view of our single oval embodiment single ball downspout joint articulated toward the front of the joint.
Figure 14:
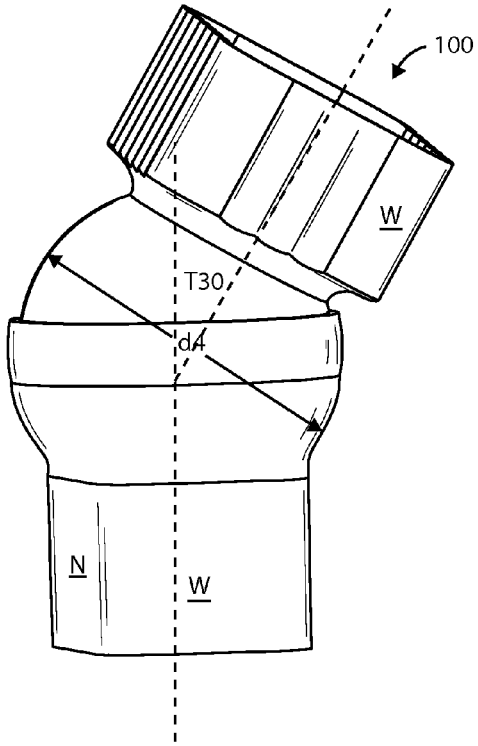
FIG. 14 is a front perspective view of our single oval embodiment single ball downspout joint articulated toward the right side of the joint.
Figure 15:
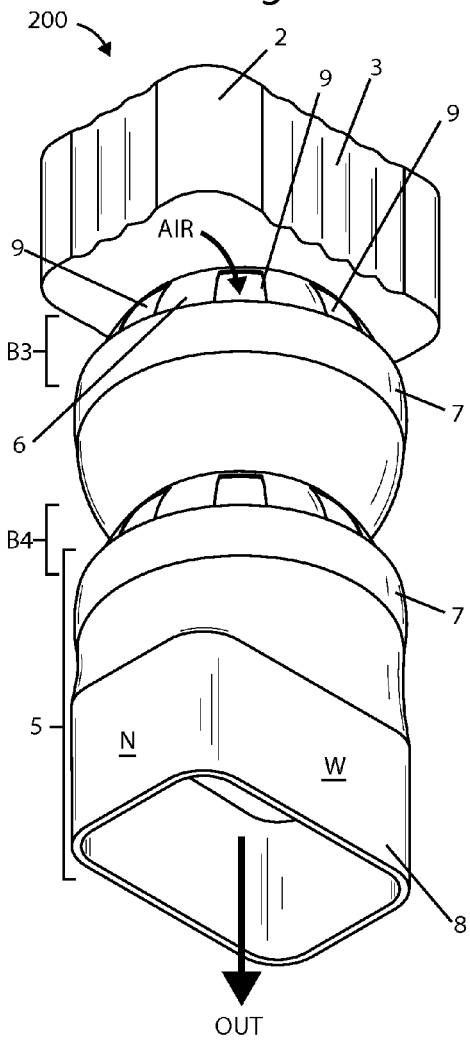
FIG. 15 is a bottom perspective view of our new design for a double ball downspout joint.
Figure 16:
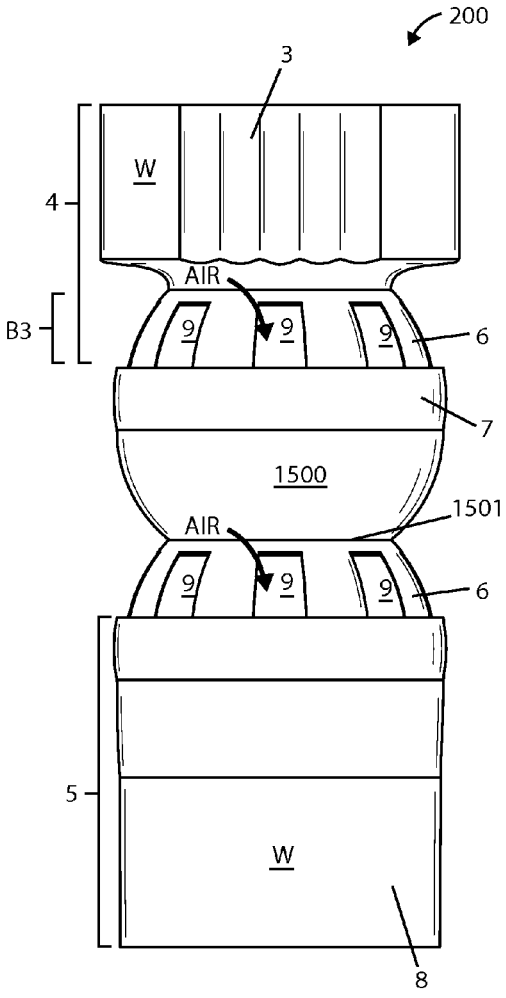
FIG. 16 is a front elevation view of our new design for a double ball downspout joint, wherein the rear elevation view is identical.
Figure 17:
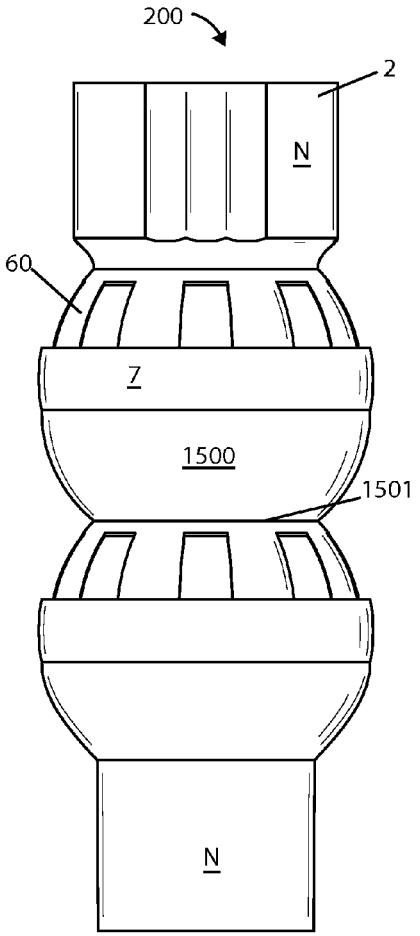
FIG. 17 is a left side elevation view of our new design for a double ball downspout joint, wherein the right side elevation view is identical.
Figure 18:
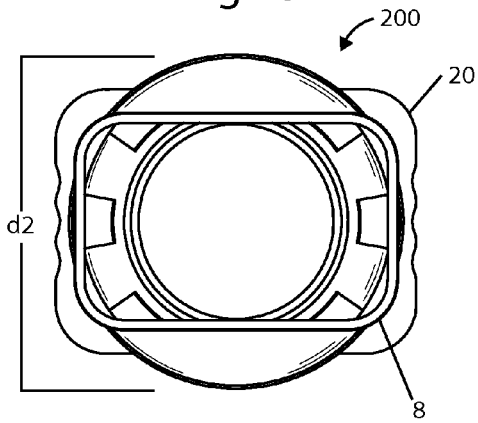
FIG. 18 is a bottom plan view of our new design for a double ball downspout joint.
Figure 19:
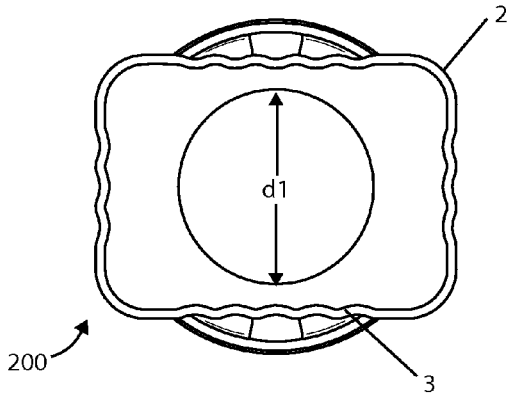
FIG. 19 is a top plan view of our new design for a double ball downspout joint.

FIGS. 6, 7 show how the ball 6 can tilt up to about 30° from its socket 7 as shown by angle T30. The diameter d2 of the socket is larger than the diameter d1 of the exit port EP of the ball 6 (see FIG. 33). Thus, no restriction of the flow orifice beyond diameter d1 occurs when the ball is tilted as in FIGS. 6, 7. All variations of tilt and rotate are possible as shown by the differing relationships of the wide and narrow sides of the rectangular adapters in FIGS. 6, 7.

Figure 36:
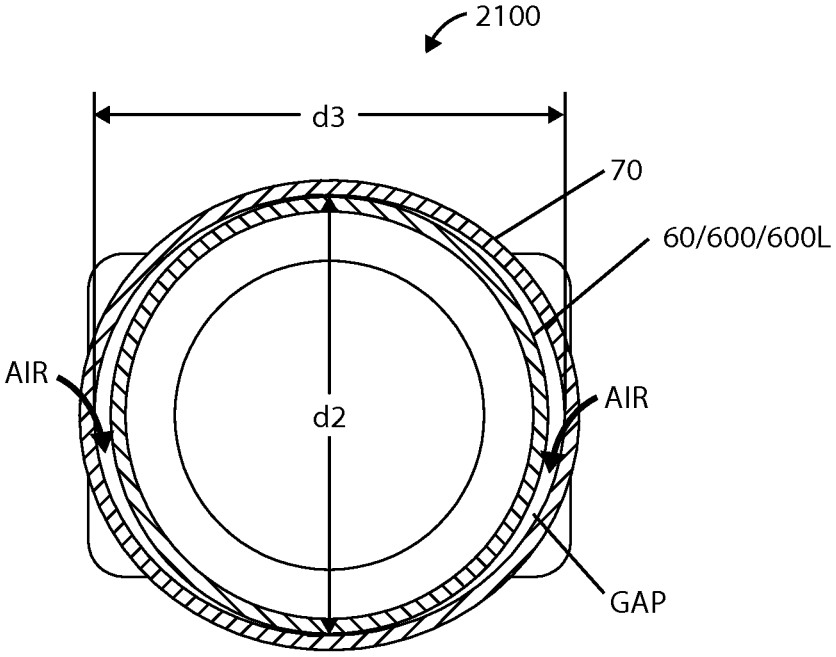
FIG. 36 is a cross sectional view along line T-T of FIG. 10.

Referring next to FIGS. 8-14 the embodiment 100 functions identically to embodiment 1. The only difference is that the recesses 9 are deleted. In order to provide for the same air flow indicated by arrow AIR, the ball 60 is still made as a sphere, but the socket 70 is made as an oval. The upper rectangular adapter 20 is the same as adapter 2. The joint is labeled B2, and it is non-sealing. The lower body 5 is the same except for the oval socket 70 (see FIG. 36). The diameter d2 is the same and oval has a larger diameter d3 with d3 greater than d2. (see FIG. 36)

Referring next to FIGS. 15-22, joint 200 is shown with two balls 6. The upper ball 6 is part of the same upper body 4. A central body 1500 has the upper socket 7 in its concave housing 1501 attached to the lower ball 6L. The upper non-sealing joint is labeled B3, and the lower non-sealing joint is labeled B4.

Figure 20:
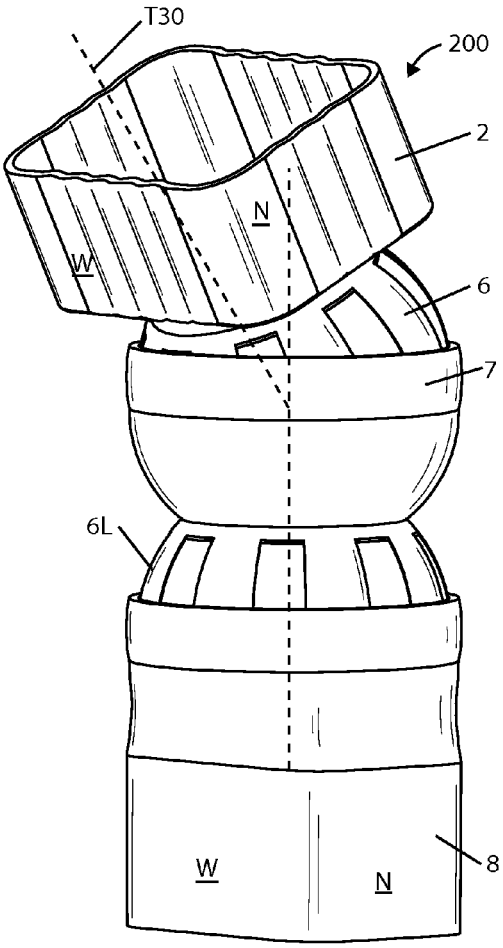
FIG. 20 is a front perspective view of our new design for a double ball downspout joint in a partially articulated position.
Figure 21:
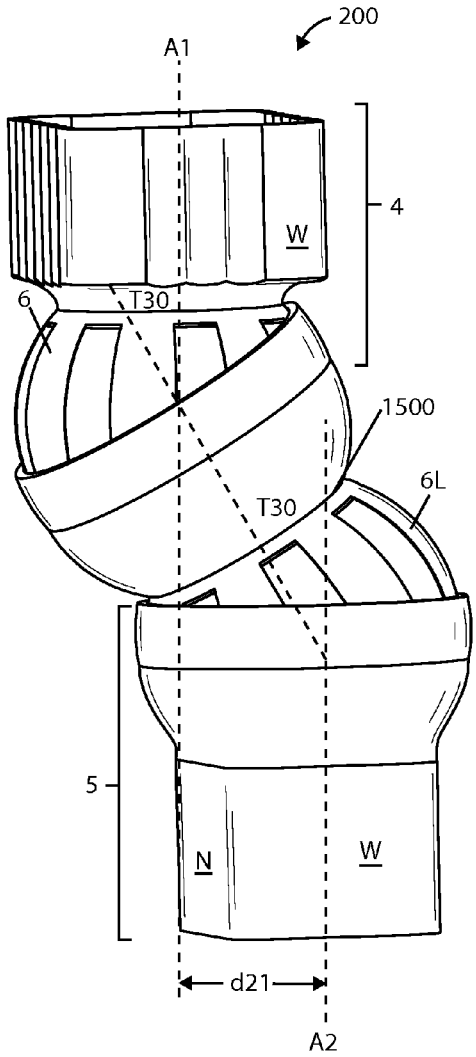
FIG. 21 is a front perspective view of our new design for a double ball downspout joint in a zigzag articulated position.
Figure 22:
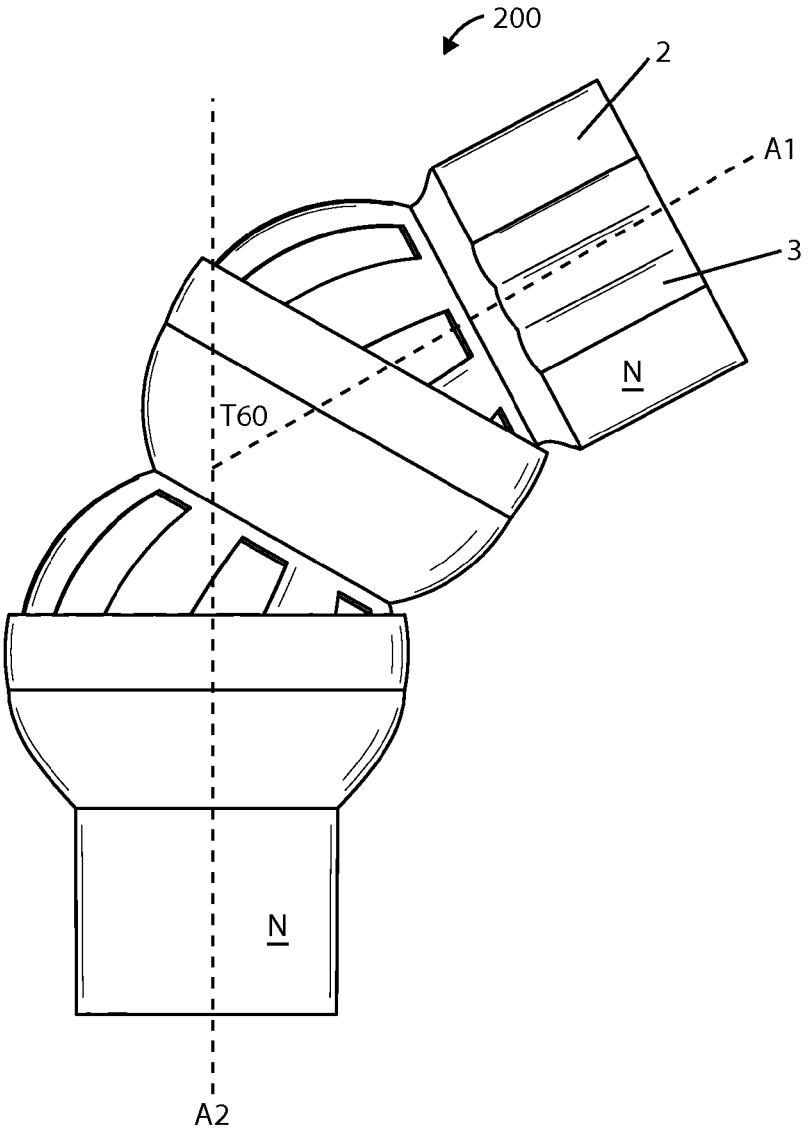
FIG. 22 is a left side elevation view of our new design for a double ball downspout joint in a fully articulated position.
Figure 23:
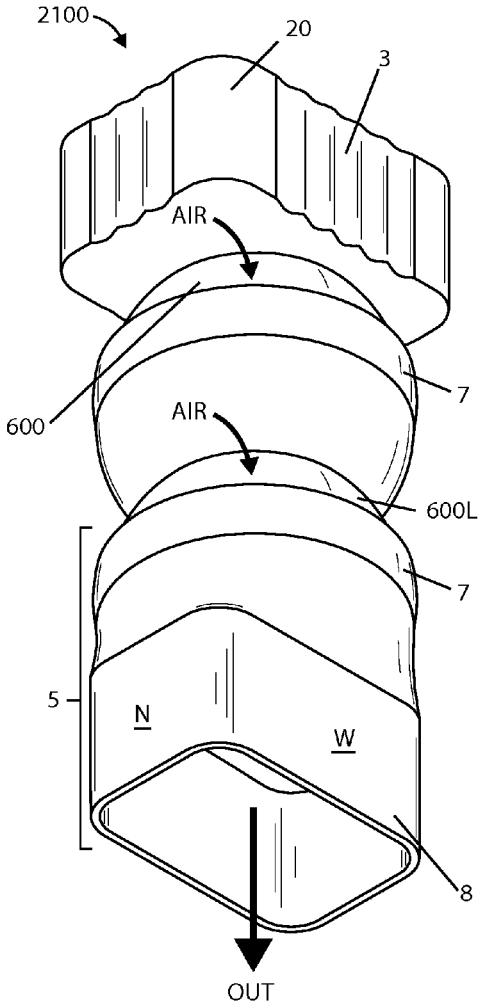
FIG. 23 is a bottom perspective view of a double oval embodiment of our new design.
Figure 24:
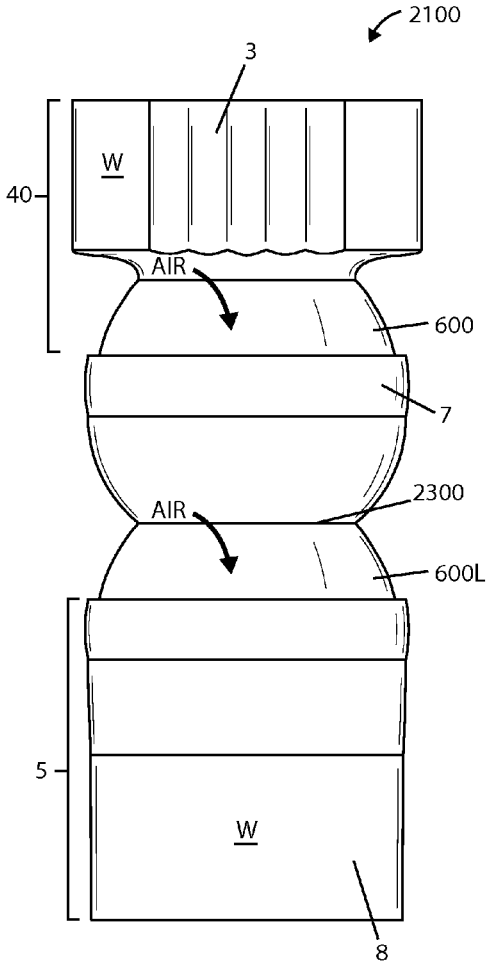
FIG. 24 is a front elevation view of our double oval embodiment for our new design, a rear elevation view is identical.
Figure 25:
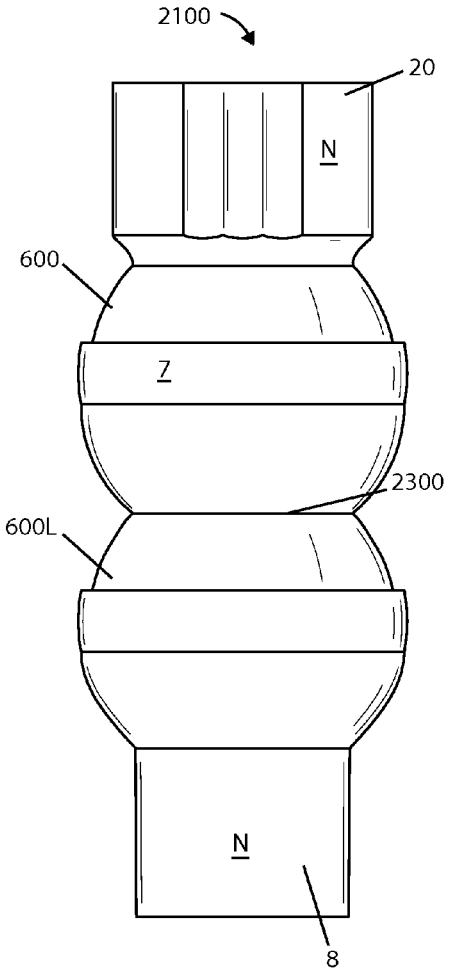
FIG. 25 is a left side elevation view of our double oval embodiment of our new design, a right side elevation view is identical.
Figure 26:
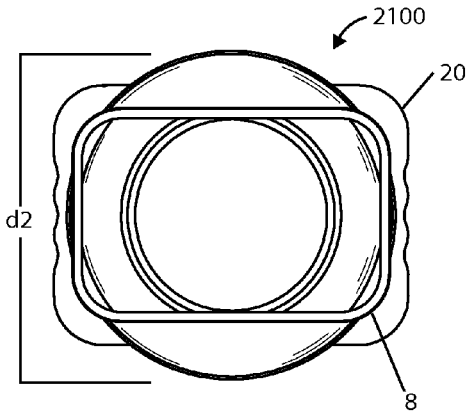
FIG. 26 is a bottom plan view of our double oval embodiment of our new design.
Figure 27:
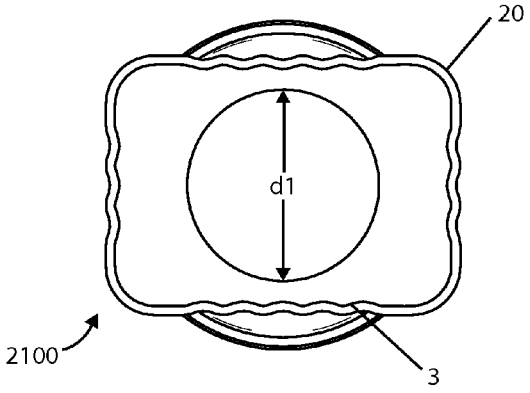
FIG. 27 is a top plan view of our double oval embodiment of our new design.
Figure 28:
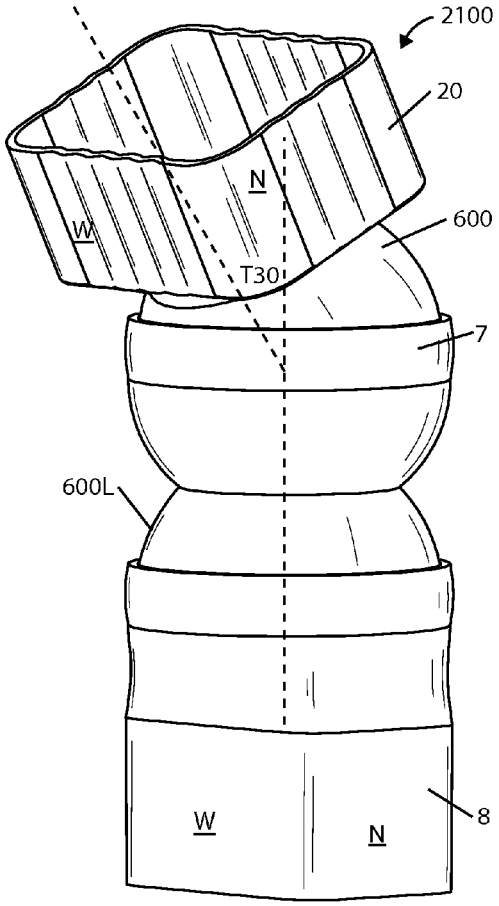
FIG. 28 is a front perspective view of our double oval embodiment of our new design in a partially articulated position.
Figure 29:
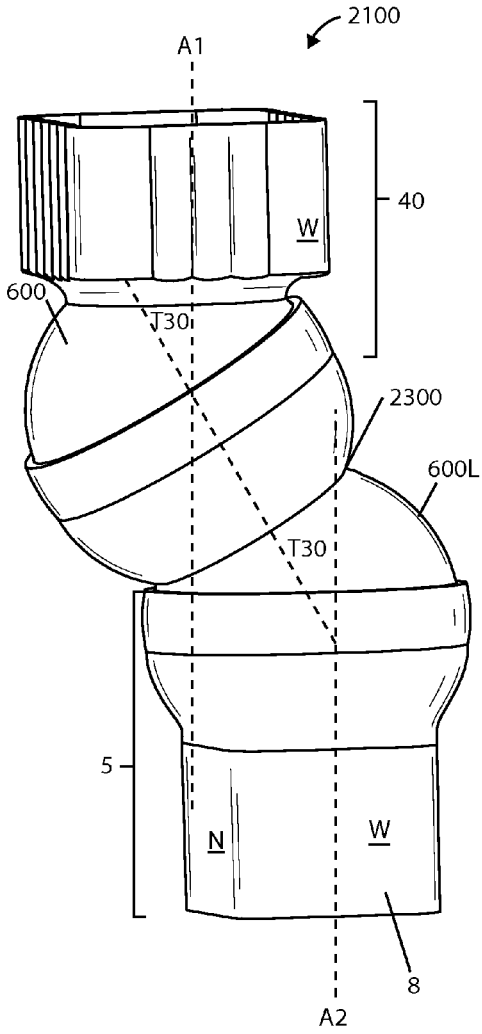
FIG. 29 is a front perspective view of our double oval embodiment of our new design in a zigzag position.
Figure 30:
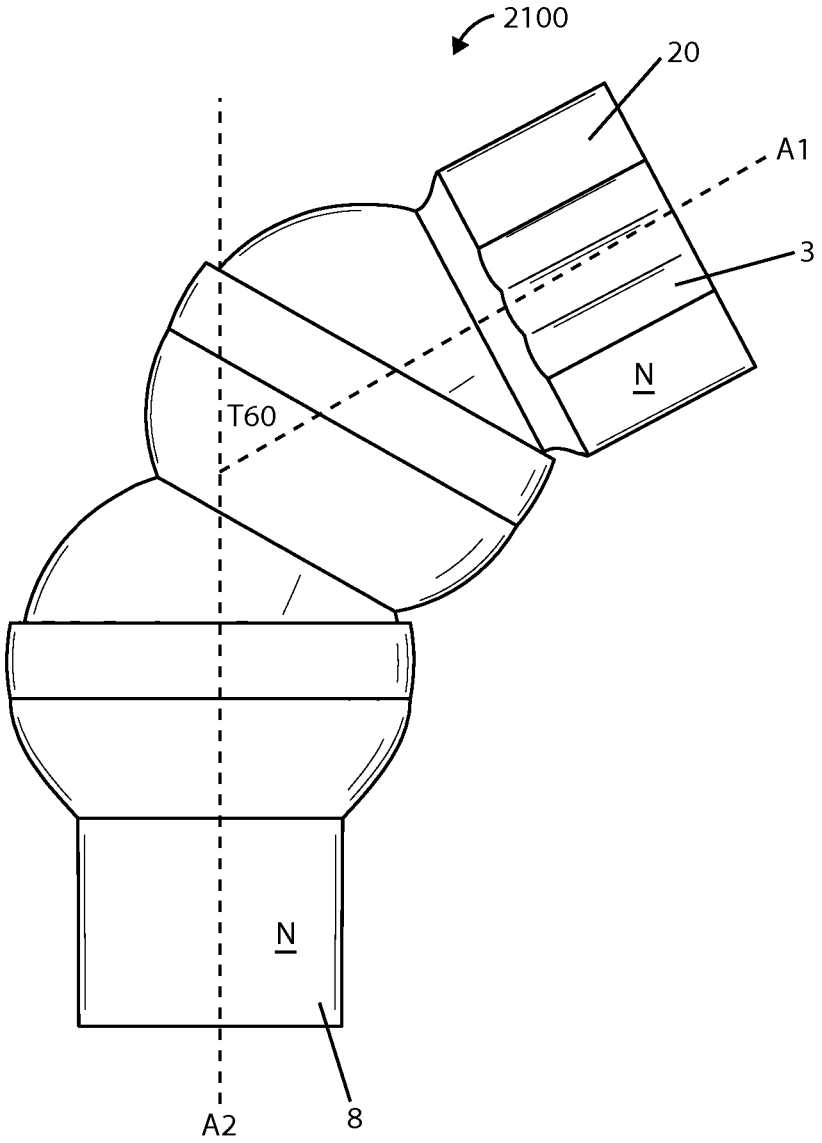
FIG. 30 is a left side elevation view of our double oval embodiment of our new design in a fully articulated position.

Referring next to FIG. 20 the upper ball 6 is tilted to angle T30, with the lower ball 6L not tilted. In FIG. 21 the upper ball 6 is tilted to angle T30 to the right. The lower ball 6L is tilted to angle T30 to the left. Thus, an offset of distance d21 is made from the central axis A1 of upper body 4. Not shown are the infinite variations of the rotational options rotating the balls 6, 6L in their respective sockets. A maximum angle T60 may be 60° from A1 to A2.

Referring next to FIGS. 23-30 double ball joint 2100 is shown to perform the same as embodiment 200. The recesses 9 are replaced with oval shaped sockets 70.

Equivalent non-sealing joints could be made with holes in the balls (not shown).

Figure 31:
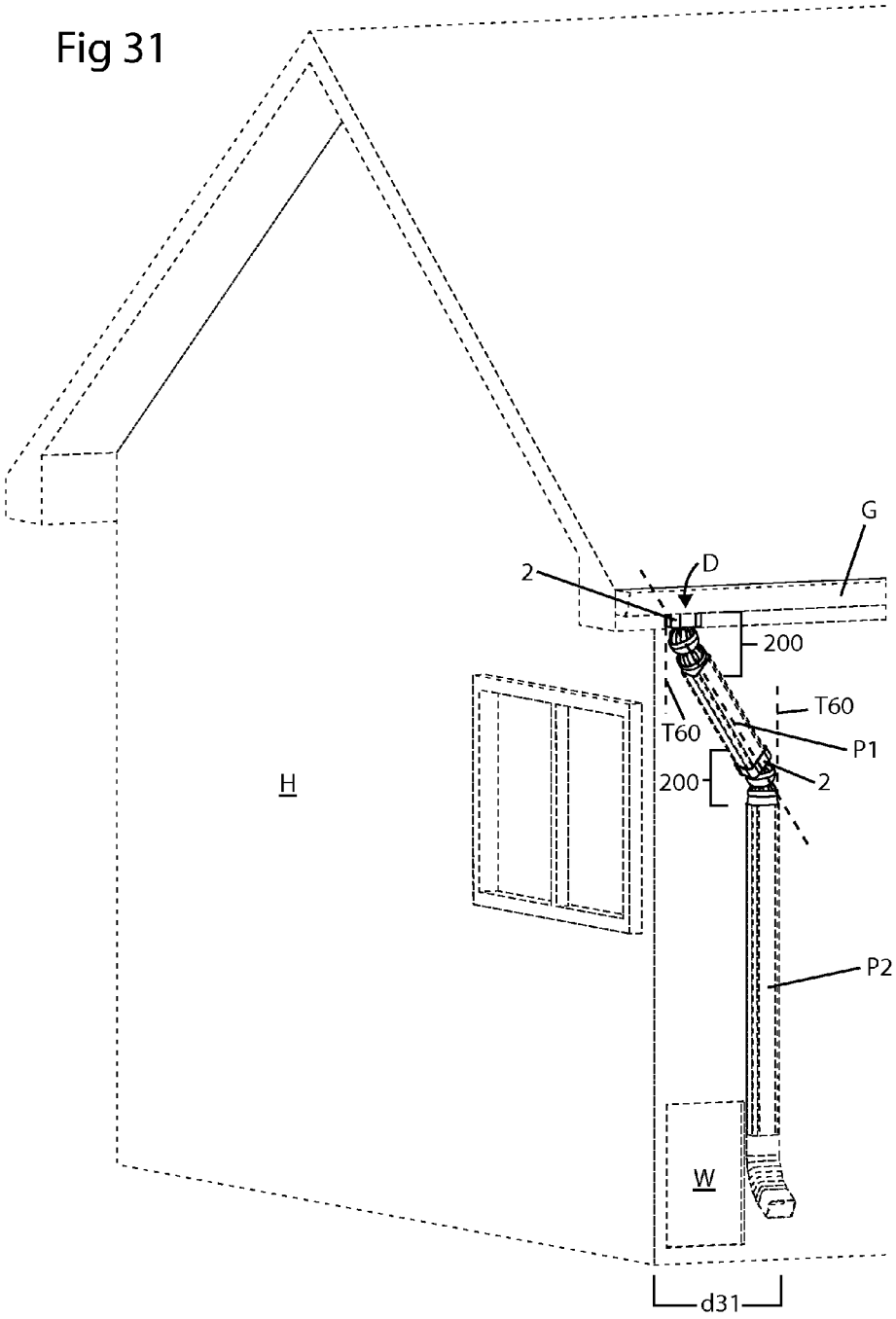
FIG. 31 is front perspective view of the FIG. 20 embodiment of our new design shown in use in the upper downspout segment, and the FIG. 22 embodiment shown in use in the lower downspout segment.

Referring next to FIG. 31 a house H has a horizontal rain gutter G with downspout D which is covered by upper rectangular adapter 2 of double ball joint 200. The zig zag offsets of downspout pipes P1, P2 create an offset distance d31 to accommodate window W.

Figure 32:
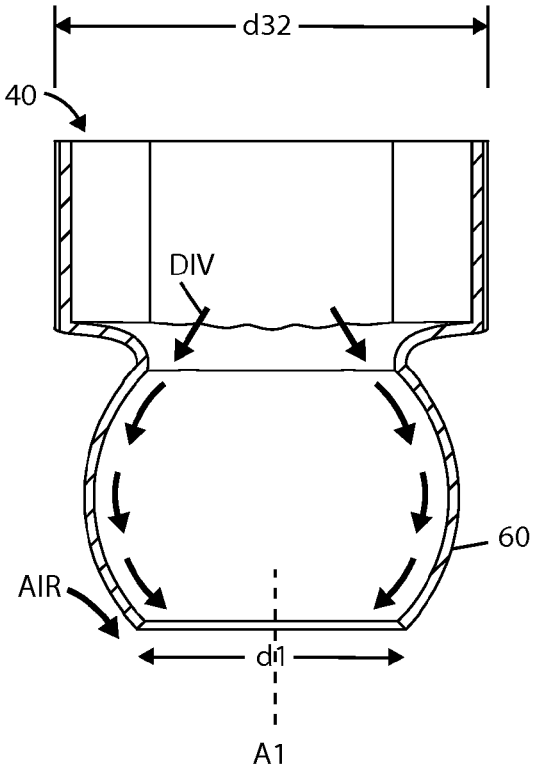
FIG. 32 is a longitudinal sectional view of the ball of the embodiment shown in FIG. 29.
Figure 33:
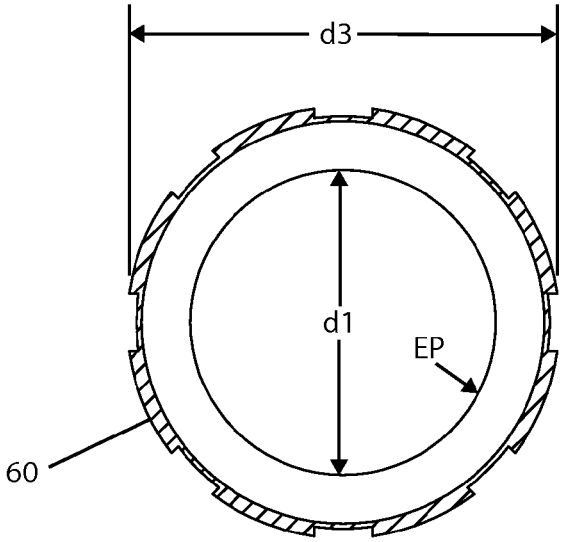
FIG. 33 is a cross sectional view of FIG. 32.
Figure 34:
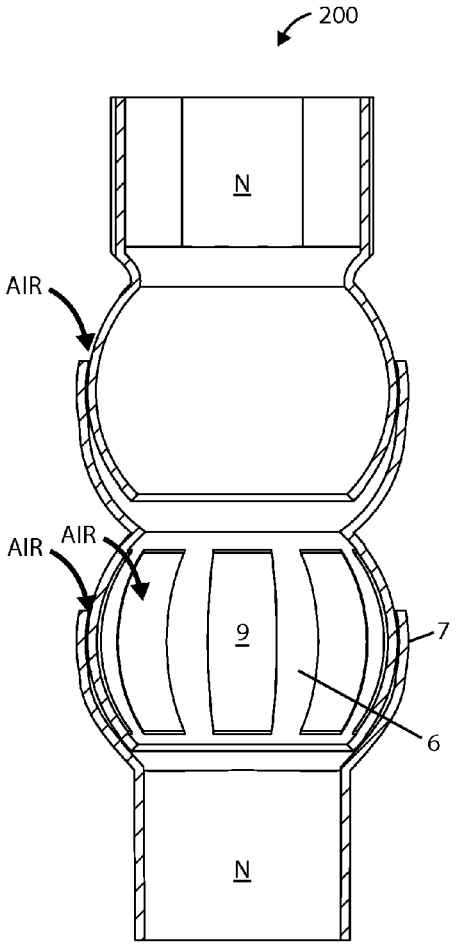
FIG. 34 is a longitudinal sectional view of the embodiment shown in FIG. 16.
Figure 35:
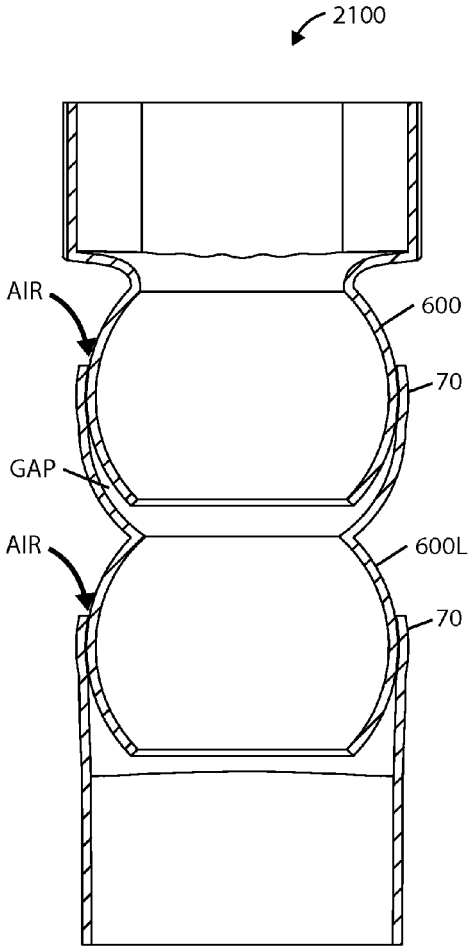
FIG. 35 is a longitudinal sectional view of the embodiment shown in FIG. 24.

Referring next to FIGS. 32, 33 the upper rectangular adapter 40 of FIG. 1 is shown. Two flow improvements are created. First the narrowing diameters from d32 to d1 create a venturi effect per Bernoulli's theorem.

Second the concave walls of ball 60 divert the flow per arrows DIV toward the central axis A1 of the adapter 40.

Additionally air via arrow AIR rushes in to alleviate any vapor locks caused by a surge of water. All these flow improvements are provided for all embodiments.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

We claim:

1. A gutter downspout joint comprising:

an upper body having an upper rectangular adaptor connected to a lower ball;

the lower ball having a hole at its top designed to provide a fluid communication channel with the upper rectangular adaptor, and having a hole at its bottom, each of said holes having a diameter of at least one inch;

the lower ball having a plurality of recesses along its outer peripheral surface;

a lower body having an upper socket to receive the lower ball;

wherein the recesses form a non-sealing joint between the lower ball and the upper socket;

the lower body having a lower rectangular adaptor designed with an upper segment to provide a fluid communication channel to the upper socket; and wherein the lower ball is tiltable and rotatable in the upper socket.

2. The joint of claim 1, wherein each of the upper body and lower body are composed of plastic.

3. The joint of claim 2, wherein the recesses further comprise vertical, rectangular shapes.

4. The joint of claim 3, wherein each of said holes has a diameter of about 2.5 inches.

5. The joint of claim 4, wherein a maximum tilt angle is about 30°.

6. A gutter downspout joint comprising:

an upper body having an upper rectangular adaptor connected to a lower ball;

the lower ball having a hole at its top designed to provide a fluid communication channel with the upper rectangular adaptor, and having a hole at its bottom, each of said holes having a diameter of at least one inch;

the lower ball having a spherical shape;

a lower body having an upper socket to receive the lower ball;

wherein the upper socket has an oval shape to form a non-sealing joint between the lower ball and the upper socket;

the lower body having a lower rectangular adaptor designed with an upper segment to provide a fluid communication channel to the upper socket; and wherein the lower ball is tiltable and rotatable in the upper socket.

7. The joint of claim 6, wherein each of the upper body and lower body are composed of plastic.

8. The joint of claim 7, wherein the oval shape of the socket forms a gap between itself and the lower ball regardless of the tilt or rotation of the lower ball.

9. The joint of claim 8, wherein each of said holes has a diameter of about 2.5 inches.

10. The joint of claim 9, wherein a maximum tilt angle is about 30°.

11. A gutter downspout joint comprising:

an upper body having an upper rectangular adaptor connected to a lower ball;

the lower ball having a hole at its top designed to provide a fluid communication channel with the upper rectangular adaptor, and having a hole at its bottom, each of said holes having a diameter of at least one inch;

the first lower ball having a plurality of recesses along its outer peripheral surface;

an intermediate body having an upper socket to receive the lower ball;

wherein the recesses form a non-sealing joint between the lower ball and the upper socket;

said intermediate body having a second lower ball having a plurality of recesses along its outer peripheral surface;

a lower body having an upper socket to receive the 1 second lower ball;

wherein the recesses of the second lower ball form a non-sealing joint between the second lower ball and the lower body upper socket;

said lower body having a lower rectangular adaptor designed with an upper segment to provide a fluid communication channel to its upper socket; and wherein each of the first and second lower balls are tiltable and rotatable in its respective upper socket.

12. The joint of claim 11, wherein each of the upper body, intermediate body, and lower body are composed of plastic.

13. The joint of claim 12, wherein the recesses of each of the first and second lower balls further comprise vertical, rectangular shapes.

14. The joint of claim 13, wherein each of said holes has a diameter of about 2.5 inches.

15. The joint of claim 14, wherein a maximum tilt angle of the joint with each of the first and second lower balls tilted in a common direction is about 60°.

16. A gutter downspout joint comprising:

an upper body having an upper rectangular adaptor connected to a lower ball;

the lower ball having a hole at its top designed to provide a fluid communication channel with the upper rectangular adaptor, and having a hole at its bottom, each of said holes having a diameter of at least one inch;

the first lower ball having a spherical body along its outer peripheral surface;

an intermediate body having an upper socket with an oval shape to receive the first lower ball;

wherein the oval shape forms a non-sealing joint between the first lower ball and the upper socket;

said intermediate body having a second lower ball having a spherical body along its outer peripheral surface;

a lower body having an upper socket with an oval shape to receive the second lower ball;

wherein the oval shape of the upper socket of the lower body forms a non-sealing joint between the second lower ball and the lower body upper socket;

said lower body having a lower rectangular adaptor designed with an upper segment to provide a fluid communication channel to its upper socket; and wherein each of the first and second lower balls are tiltable and rotatable in its respective upper socket.

17. The joint of claim 16, wherein each of the upper body, intermediate body and lower body are composed of plastic.

18. The joint of claim 17, wherein the oval shape of each sockets forms a gap between itself and its respective ball regardless of the tilt or rotation of the lower ball.

19. The joint of claim 18, wherein each of said holes has a diameter of about 2.5 inches.

20. The joint of claim 19, wherein a maximum tilt angle of the joint with each of the first and second lower balls tilted in a common direction is about 60°.

* * * * *